United States Patent [19]

Jay

[11] 3,992,728

[45] Nov. 23, 1976

[54] WATER SAVING TOILET DEVICE

[76] Inventor: Walter M. Jay, 8422 Neva Ave., San Diego, Calif. 92123

[22] Filed: Oct. 28, 1975

[21] Appl. No.: 626,468

[52] U.S. Cl. ..... 4/67 R; 4/67 A

[51] Int. Cl.[2] ..... E03D 3/12; A61B 19/00

[58] Field of Search ..... 4/67 R, 67 A, 57 P, 4/57 R, 34, 37, 1

[56] References Cited

UNITED STATES PATENTS

| | | | |
|---|---|---|---|
| 2,583,468 | 1/1952 | Castallano | 4/67 A |
| 2,627,608 | 2/1953 | Edwarde | 4/67 R |
| 2,746,060 | 5/1956 | Troyano | 4/67 A |
| 2,879,522 | 3/1959 | Stump | 4/67 R |

FOREIGN PATENTS OR APPLICATIONS

| | | | |
|---|---|---|---|
| 125,579 | 10/1947 | Australia | 4/67 R |
| 149,045 | 12/1952 | Australia | 4/67 R |

*Primary Examiner*—Henry K. Artis

[57] ABSTRACT

This device consists primarily of a U-shaped member which is secured to the lift lever and lift rod by bolt fastener means, the structure being such, that when the lift lever is actuated by the attached lever handle, the valve will open and a discharge of water will pass from the tank, and with an upward pressure on the lever handle immediately following the opening of the valve, the valve will close and prevent further discharging of water in reserve within the tank.

1 Claim, 3 Drawing Figures

WATER SAVING TOILET DEVICE

This invention relates to domestically used water closets, and more particularly to a water saving toilet device.

It is therefore the principal object of this invention to provide a water saving toilet device which will be of such structure, that when in use, will economize the use of water in any water closet or toilet that is domestically used. Another object of this invention is to provide a water saving toilet device which by controlling the flow of water, will save approximately 20 to 50% of water.

A further object of this invention is to provide a toilet device of the type described, which when activated by the toilet tank lever handle, will open the valve and when the lever is lifted immediately following, the device will close the valve after double action of the lever handle is not applied, the regular cycle of water flow will automatically occur.

Other objects of the invention are to provide a water saving toilet device, which will be simple in design, inexpensive to manufacture, rugged in construction, easy to use and efficient in operation.

These and other objects will be readily evident upon a study of the following specification and the accompanying drawing wherein.

Figure 1:
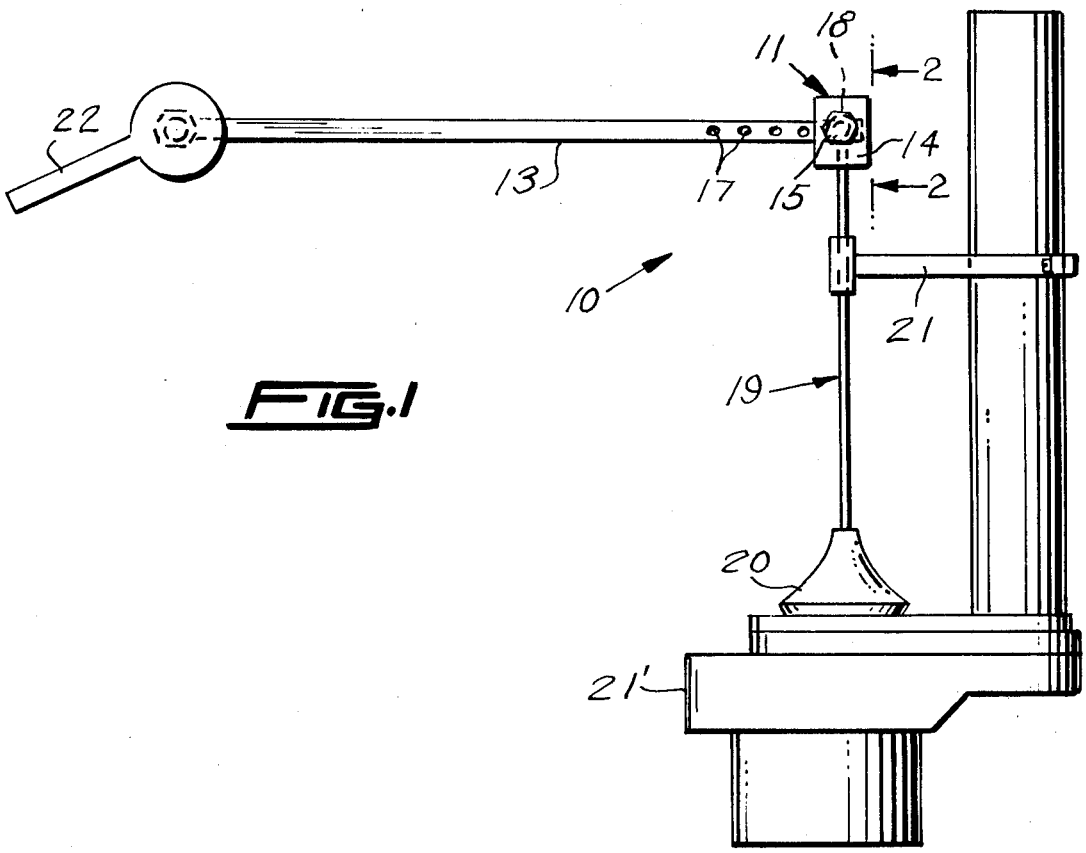
FIG. 1 is a space view of a water closet flush mechanism, shown in elevation and illustrating the present invention installed thereon.
Figure 2:
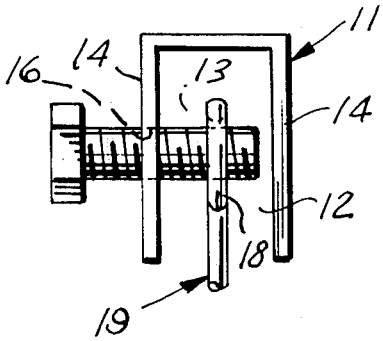
FIG. 2 is an enlarged view of the invention taken along the line 2—2 of FIG. 1 and shows a lift lever in phantom lines.
Figure 3:
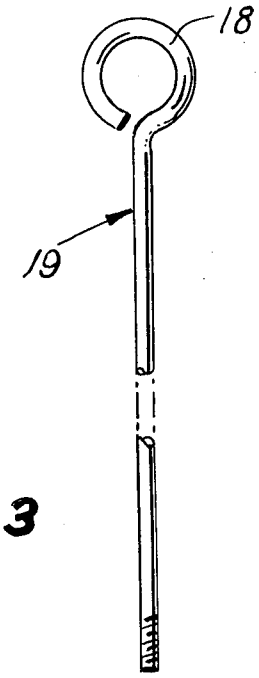
FIG. 3 is a vertical side view of the lift rod shown in elevation and removed from FIG. 1.

According to this invention, a water saving toilet device 10 is shown to include a U-shaped member 11 made of copper or suitable material. The opening 12 freely receives lift lever 13, the opening 12 being defined by the parallel legs 14 of member 11. A bolt fastener 15 is threadably received in an opening 16 of one of the legs 14 and is received within one of the plurality of spaced apart openings 17 of the lever 13 there is also freely received within eye 18 of lift rod 19 to which is threadably attached rubber ball 20 which seats within valve 21. Lift rod 19 is supported freely in a normal manner within lift rod guide 21. Lever handle 22 is secured in a well known manner, to the opposite end of lift lever 13.

In use, lever handle 22 is pivoted downward in the well known manner, but just for a moment, the result being that rubber ball 20 will be lifted from the seated valve 21' which will enable water to flow from the tank and as soon as the water begins to discharge, the user immediately applies a slight upward motion against lever handle 22, the result being that rubber ball 20 will descend upon the seat of valve 21 and thus the discharge of water ceases.

What I now claim is:

1. A water saving toilet device, comprising in combination, a manually operated lever handle supported on a pivot shaft that is supported on a toilet tank, said lever handle being affixed respective to a lift lever so that when said lever handle is pivoted about said pivot shaft, said lift lever is likewise pivoted, said lift lever at one end having a row of openings therethrough transversely, one of said openings selectively receiving a bolt fastener therethrough, said bolt fastener also being received through an eye formed at an upper end of a vertically extending downward lift rod, said bolt fastener also being received through a U-shaped member that includes parallel, spaced apart legs each of which has an opening therethrough for receiving said bolt fastener, said downwardly extending lift rod being slideably supported in a rod guide stationarily secured to an overflow pipe of said toilet tank, and a lower end of said lift rod having a rubber ball secured thereto, said rubber ball seating on a valve seat in a water discharge pipe, which communicates with a toilet bowl.

* * * * *